US008984846B2

(12) United States Patent
Klein

(10) Patent No.: US 8,984,846 B2
(45) Date of Patent: Mar. 24, 2015

(54) CONTAINER CLOSURE TOOL

(76) Inventor: Oriya Klein, Brooklyn, NY (US)

( * ) Notice: Subject to any disclaimer, the term of this patent is extended or adjusted under 35 U.S.C. 154(b) by 464 days.

(21) Appl. No.: 13/337,173

(22) Filed: Dec. 26, 2011

(65) Prior Publication Data

US 2012/0324838 A1 Dec. 27, 2012

Related U.S. Application Data

(60) Provisional application No. 61/427,184, filed on Dec. 26, 2010.

(51) Int. Cl.

| | |
|---|---|
| ***B67B 3/18*** | (2006.01) |
| ***B65B 7/28*** | (2006.01) |
| ***B65B 67/00*** | (2006.01) |
| *B65B 25/00* | (2006.01) |

(52) U.S. Cl.

CPC . *B65B 7/28* (2013.01); *B65B 25/00* (2013.01); *B65B 67/00* (2013.01); *B65B 7/2857* (2013.01)

USPC ..... 53/488; 53/478; 413/38; 413/39; 413/40

(58) Field of Classification Search

CPC ..... B21D 51/32; B21D 51/34

USPC ..... 53/410, 488, 478, 334; 413/38, 39, 31, 413/40

See application file for complete search history.

(56) References Cited

U.S. PATENT DOCUMENTS

| | | | | | |
|---|---|---|---|---|---|
| 287,784 | A * | 10/1883 | Whitaker | 413/38 |
| 426,825 | A * | 4/1890 | Lewis | 413/39 |
| 502,339 | A * | 8/1893 | Wilson | 413/38 |
| 538,942 | A * | 5/1895 | Wood | 413/38 |
| 554,554 | A * | 2/1896 | Westerbeck | 413/38 |
| 909,254 | A * | 1/1909 | Taylor et al. | 413/38 |
| 1,067,160 | A * | 7/1913 | Wood | 413/38 |
| 1,351,831 | A * | 9/1920 | Brenzinger | 413/39 |
| 1,367,953 | A * | 2/1921 | Englund | 413/38 |
| 1,370,040 | A * | 3/1921 | Newman | 413/40 |
| 1,439,673 | A * | 12/1922 | Lochhead | 413/38 |
| 1,460,398 | A * | 7/1923 | Augensen | 413/38 |
| 1,640,585 | A * | 8/1927 | Thornton | 413/39 |
| 1,704,405 | A * | 3/1929 | Peelle | 53/334 |
| 1,744,661 | A * | 1/1930 | Nelson | 413/39 |
| 2,017,495 | A * | 10/1935 | Grotnes | 413/38 |
| 2,023,598 | A * | 12/1935 | Kronquest | 413/39 |
| 2,055,998 | A * | 9/1936 | Burpee | 413/39 |
| 2,181,237 | A * | 11/1939 | Ives | 413/39 |
| 2,213,971 | A * | 9/1940 | Gar | 413/38 |
| 2,237,109 | A * | 4/1941 | Nickels | 413/39 |
| 2,368,817 | A * | 2/1945 | Fischer | 413/38 |
| 2,410,263 | A * | 10/1946 | Brenzinger | 413/39 |
| 2,933,873 | A * | 4/1960 | Swanson | 53/334 |
| 4,803,829 | A * | 2/1989 | Scheidegger | 53/442 |
| 4,811,550 | A * | 3/1989 | Hautemont | 53/478 |
| 7,690,172 | B2 * | 4/2010 | Denis | 53/366 |
| 2011/0229288 | A1 * | 9/2011 | Sanz | 413/39 |

* cited by examiner

*Primary Examiner* — Stephen F Gerrity
*Assistant Examiner* — Eyamindae Jallow
(74) *Attorney, Agent, or Firm* — Edward Langer Adv. and Patent Attorney

(57) ABSTRACT

A hand-held closure tool for closing a container. Based on the design of the inventive closure tool, a pair of wheels provides two points of contact between the closure tool and the container peripheral flange. This design feature stabilizes the closure tool as the container is moved in a circular fashion. The stability of the closure tool against the peripheral flange of the container enables the closure tool movement to be accomplished in a single, continuous motion.

11 Claims, 7 Drawing Sheets

CONTAINER CLOSURE TOOL

FIELD OF THE INVENTION

The present invention relates to food storage containers and lids for closing and sealing same, and more particularly, to hand tools and accessories for closing containers by placement of a lid designed for retention by a foldable edge of the container.

BACKGROUND OF THE INVENTION

Food storage containers come in many different varieties, and are a common item for kitchen and restaurant use. In the home, they are typically made of plastic, designed to be sealed by a fitted interlocking of the container and a removable lid. Examples of these type of containers are known by their tradenames and trademarks, such as Tupperware, Rubbermaid, Zip-Lock and others. These are generally designed so that the sealing of the lid and container maintain an airtight seal as much as possible, to insure freshness of the stored food contents over a period of time.

Restaurants also use food storage containers, such as aluminum foil containers or paper containers, plastic, etc. The containers may have various shapes, such as round or rectangular. These containers are typically used for food prepared by the restaurant and meant for home or hotel delivery, or as take-out orders by customers who enter the restaurant. Along with the term "restaurant" is included a wide range of various types of food establishments, including the popular types of hamburger eateries, fish restaurants and pizza stores, etc.

Aluminum foil containers are typically designed with a peripheral vertical flange which can be folded over to retain a foil-backed or paper lid, and although this type of closure may not be airtight, the closed container is useful for storage of food under controlled conditions such as in a refrigerator. Even without the use of a refrigerator to maintain food freshness as a function of temperature, the aluminum foil container is an effective way of storing food for short periods. For example, aluminum foil containers are used for delivery of food by a food establishment, such as take-out orders, where the prepared food is shipped in the foil container and meant for immediate consumption in the home once delivered.

In this use of foil containers for delivery of prepared food, the food establishment typically has a stock of these containers and lids in the kitchen area to be used by the food preparation staff. Once the food preparation staff places the prepared food in the foil container, the lid must be placed over the container before the container can be delivered. In cases where hot food is being prepared, it is important to close the food container as quickly as possible, in an attempt to retain the heat within the closed container. In many cases, the food preparer simply bends the vertical flange using his or her fingers, but this is unsafe since the sharpness of the foil edge presents the risk of injury by cuts to the fingers. The task of closing the foil container quickly has been simplified by the use of hand-held tools, developed specifically for this use.

Examples of prior art tools used for closing or sealing food containers are published in the following US patents and/or patent applications, and design patents:

U.S. Pat. No. 4,170,862 to Lazure discloses a device or tool for crimping the lid of a container onto the container;

U.S. Pat. No. 2,784,543 to Barr discloses a tool for sealing a container in which a ring is placed onto the top of the lid and then pressed around the circumference of the lid, sealing it;

US Pat. Appln. 2003/0205032 to Guiliano et al. discloses a tool for pressing closed a foil or aluminum lid onto a container;

U.S. Pat. No. 3,905,174 to Heisler discloses a crimping or pressing tool for manually pressing an aluminum lid onto a container;

U.S. Pat. No. 5,140,796 to Pope discloses a hand-held tool for closing a food storage bag in which the edge of the bag is pinched between the tool and then pulled along the edge of the bag, sealing it; and U.S. Design Pat. No. 386,654 to Kosmyna illustrates a design for a tool to seal a plastic food storage container.

The hand-held tools described above are generally designed for hand manipulation when applied to the container to enable bending, folding or pushing a sealing portion of the container design into contact with another surface, such as the edge of a lid or other portion of the container, to close it.

The Guiliano et al tool is shaped as a rod having a wheel attached at one end, and the wheel is shaped to engage a peripheral flange of a round aluminum foil container body and bend and crimp it, so as to close it against the outer edge of the lid. The wheel provides a single point of contact with the container flange at any moment, and the wheel is manipulated to roll around the container perimeter. Because of its design, the single point of contact must be maintained between the wheel and the container flange, or else during the manipulation, the wheel slips off the container flange, and must be relocated to complete the task of rolling around the perimeter. This slows the procedure of closing the lid onto the container, and requires multiple relocations.

Therefore, it would be desirable to provide a hand tool for closing a container lid onto the container, in a quick, efficient and easy to perform hand manipulation.

SUMMARY OF THE INVENTION

Accordingly, it is a principal object of the present invention to overcome the disadvantages associated with prior art hand tools for closing a container lid onto a container, and provide a simple and efficient tool for performing this task with minimal hand manipulation, to speed the closure procedure and minimize the risk of injury.

In accordance with a principal object of the present invention, there is provided a container closure tool comprising:

a hand-held housing;

at least one pair of wheels each rotatably mounted on a respective back and front end of said housing, each wheel being formed with a tapered contour, said contour being oriented so as to face outwardly of said housing on the bottom of said wheel, such that when a lid is placed over the container with the outer edge of the lid aligned proximate a peripheral vertical flange of the container all along its circumference, and said tapered contour of each of said at least one pair of wheels is simultaneously placed so as to engage the peripheral flange of the container, said at least one pair of wheels providing at least two points of contact between said closure tool and the container peripheral flange, said both points of contact providing both bending and crimping action simultaneously, so that application of closure toot pressure against said flange while moving the container in a circular direction causes simultaneous bending and crimping action on said flange inwardly at said two points of contact so as to retain the container lid all along its circumference in a single, continuous hand motion.

In a preferred embodiment, the housing is provided with two identical side portions, made of a rigid material such as molded plastic, each having an upper end and a lower end. The pair of side portions are spaced apart from one another and extend parallel to each other, defining a hollow space therebetween, for mounting a pair of wheels. The lower ends of the side portions are arch-shaped defining a pair of oppositely located corners. Formed on the upper end of the side portion is an elongated handle formed with ribs for easy grasping.

Each of the wheels is formed with a tapered contour, which faces outwardly from the bottom of the closure tool and is thereby exposed in order to engage a peripheral flange formed on the container, with the flange being thin enough to bend.

The housings two side portions together with the wheels mounted therebetween form the inventive closure tool, which can be manipulated to close a container.

When a lid is placed over the top of the container so that its outer edge is aligned proximate a peripheral vertical flange of the container all along its circumference, the closure tool can be used to close the foil container. This is achieved by applying pressure via the pair of closure tool wheels against the peripheral flange of the container, thereby bending it over the edge of the lid, as the container is moved in a circular fashion, while holding the closure tool in the other hand, thereby closing it.

Based on the design of the inventive closure tool, the pair of wheels provides two points of contact between the closure tool and the container peripheral flange. This design feature stabilizes the closure tool as the container is moved in a circular fashion. The stability of the closure tool against the peripheral flange of the container enables the closure tool movement to be accomplished in a single, continuous motion.

In accordance with a principal object of the present invention, there is provided a method for closing a food container comprising the steps of:

providing a container closure tool comprising:

a hand-held housing;

at least one pair of wheels each rotatably mounted on a respective back and front end of said housing, each wheel being formed with a tapered contour, said contour being oriented so as to face outwardly of said housing on the bottom of said wheel, placing a lid over the container with the outer edge of the lid aligned proximate a peripheral vertical flange of the container all along its circumference, placing said tapered contour of each of said at least one pair of wheels simultaneously so as to engage the peripheral flange of the container, said at least one pair of wheels providing at least two points of contact between said closure tool and the container peripheral flange, said both points of contact providing both bending and crimping action simultaneously, and applying closure tool pressure against said flange while moving the container in a circular direction causing simultaneous bending and crimping action on said flange inwardly at said two points of contact so as to retain the container lid all along its circumference in a single, continuous hand motion.

Other features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding sections or elements throughout, and in which.

DETAILED DESCRIPTION OF THE PREFERRED EMBODIMENTS

Figure 1:
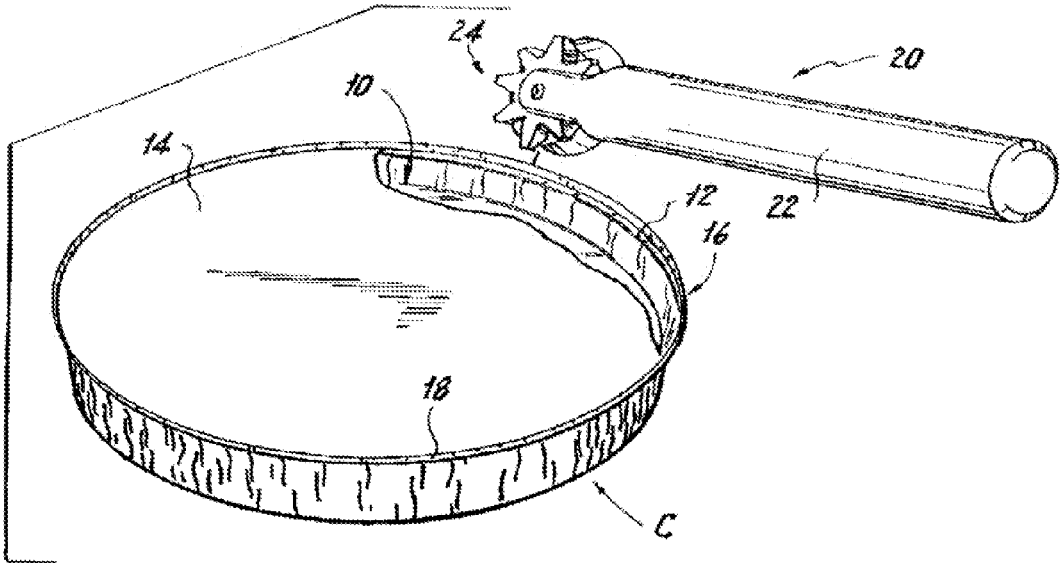
FIG. 1 PRIOR ART
FIG. 1 illustrates a prior art tool for closing a container by crimping the container's peripheral flange over the periphery of the lid.

Referring now to FIG. 1, there is shown a prior art tool for closing a foil container by crimping the container's peripheral flange over the periphery of the lid. As described in US Pat. Appln. Pub No. 2003/0205032, a foil container C comprises a flat bottom portion 10 and a circumferential vertical wall 12, and is covered by a lid 14 supported by the upper portion 16 of wall 12, at which there is formed a peripheral edge 18. Tool 20 comprises an elongated rod 22 having a wheel 24 mounted at one end thereof. Wheel 24 is shaped with an annular groove 26 which divides the wheel into two half-sections, with one of the sections 28 shaped as a star and the other half-section 30 shaped as a disc.

In use, the prior art tool 20 is applied to the foil container so that the annular groove 26 engages peripheral edge 18. When pressure is applied as the tool 20 is pushed with a circular motion around the perimeter of the foil container C, peripheral edge 18 is crimped over the outer edge of lid 14, thereby closing the container with the lid.

Because of its design, prior art tool 20 provides only a single point of contact with the peripheral edge 18 as the circular motion of tool 20 is applied. As a result, it is difficult to maintain the circular motion of tool 20 in continuous fashion, since occasionally the tool 20 slips off the peripheral edge 18. In this event, tool 20 must be relocated on peripheral edge 18 of container C, in order to complete the closing activity.

Figure 2:
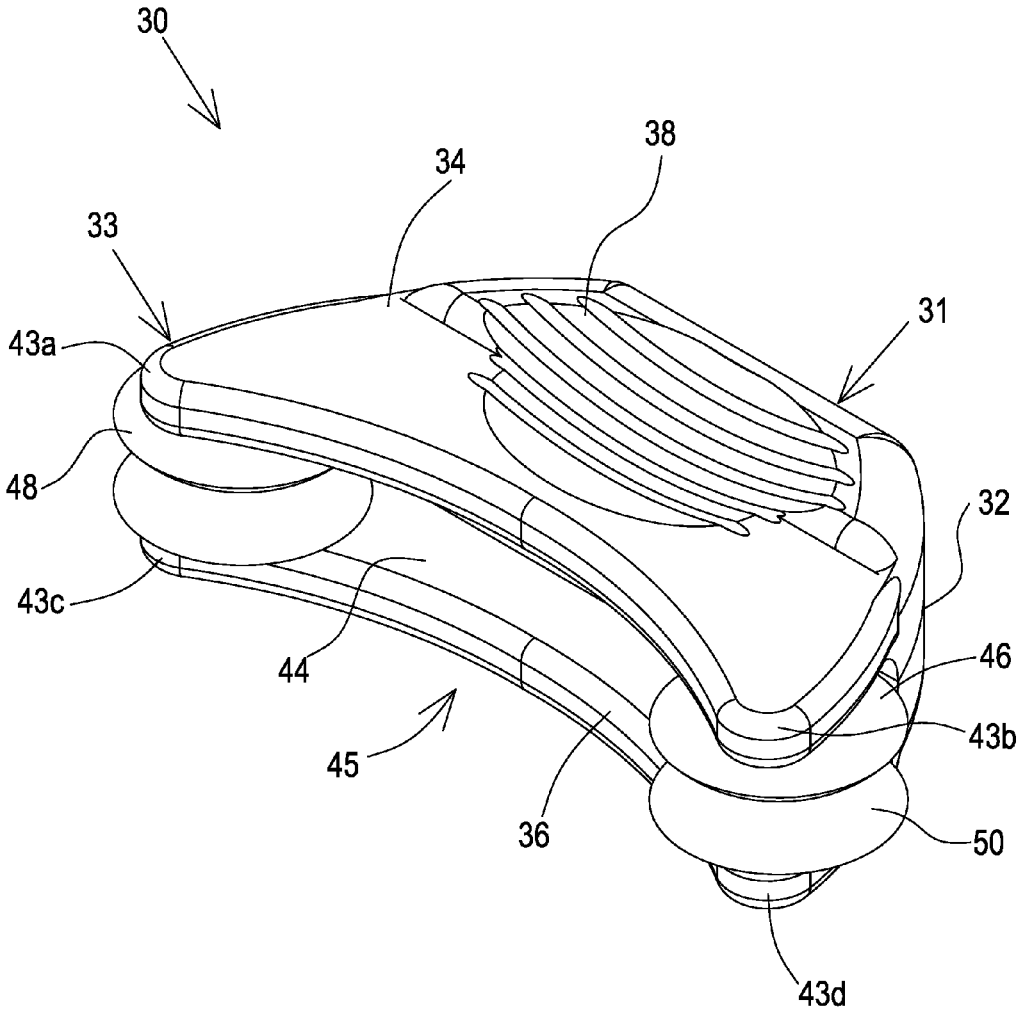
FIG. 2 shows a perspective view of the inventive closure tool, constructed and operated in accordance with the principles of the present invention.

Referring now to FIG. 2, there is shown a perspective view of a closure tool 30 constructed and operated in accordance with the principles of the present invention. Closure tool 30 comprises a housing 32, formed by a pair of side portions 34, 36 which are identical to each other, and are constructed of rigid materials, typically injection-molded plastic. The pair of side portions 34, 36 are spaced apart from one another and extend parallel to each other, defining a hollow space 44 therebetween, for mounting a pair of wheels 46, 48. Lower ends 33 of side portions 34, 36 are arch-shaped defining a pair of oppositely located corners 43*a*, 43*b* and 43*c*, 43*d*, respectively. Formed on upper end 31 of side portion 34 is an elongated handle 38 formed with ribs for easy grasping.

Each of wheels 46, 48 is formed with a tapered contour 50, which faces outwardly from the bottom of closure tool 30 and is thereby exposed.

Figure 3:
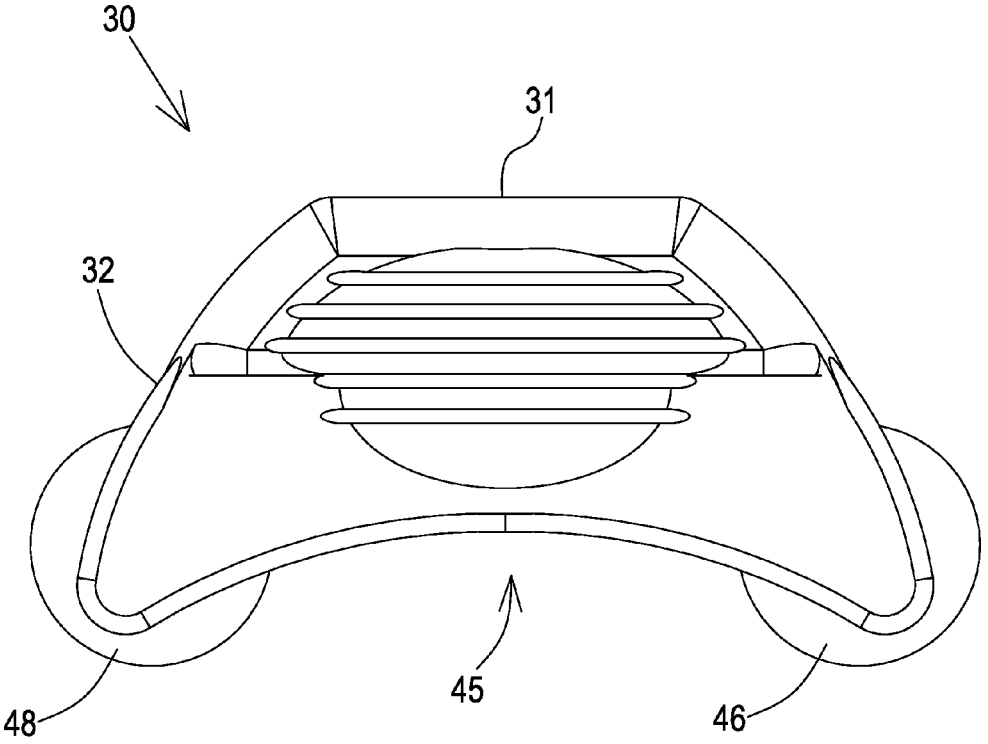
FIG. 3 shows a side view of the inventive closure tool of FIG. 2.

Referring now to FIG. 3, there is shown a side view of closure tool 30 showing wheels 46, 48 mounted in housing 32.

Figure 4:
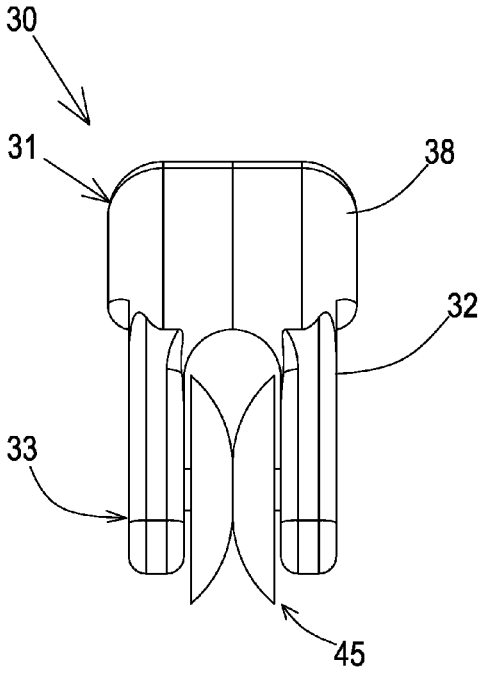
FIG. 4 shows an end view of the inventive closure tool of FIG. 2.
Figure 5:
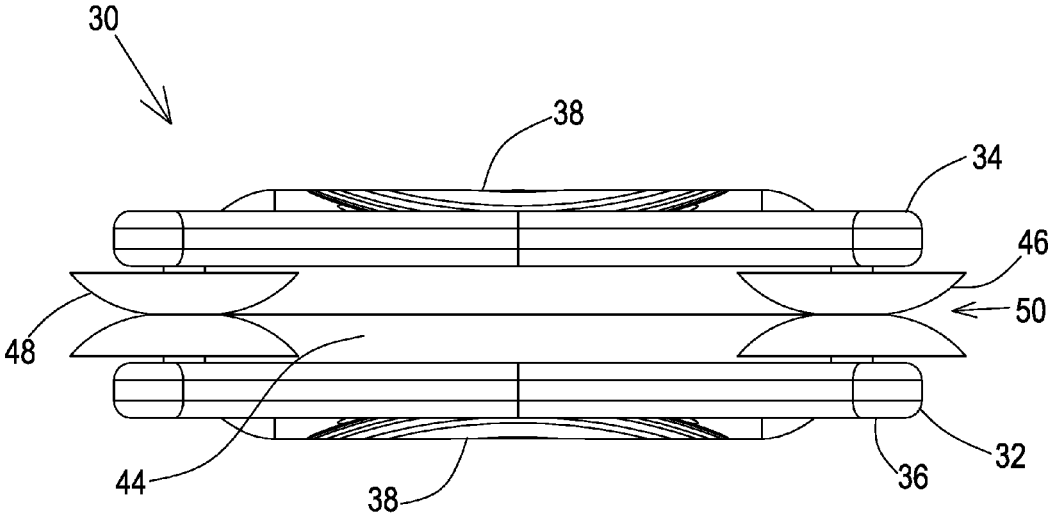
FIG. 5 shows a bottom view of the inventive closure tool of FIG. 2.

Referring now to FIG. 4, there is shown an end view of closure tool 30, as seen in accordance with directional arrows A-A of FIG. 3. In this view, only wheel 46 is visible, and as shown in FIG. 5, both wheels 46, 48 are mounted within housing 32, as further described. An end view of handle 38 is also shown.

Referring now to FIG. 5, there is shown a bottom view of closure tool 30 showing both wheels 46, 48 mounted between side portion 34 and side portion 36.

Figure 6:
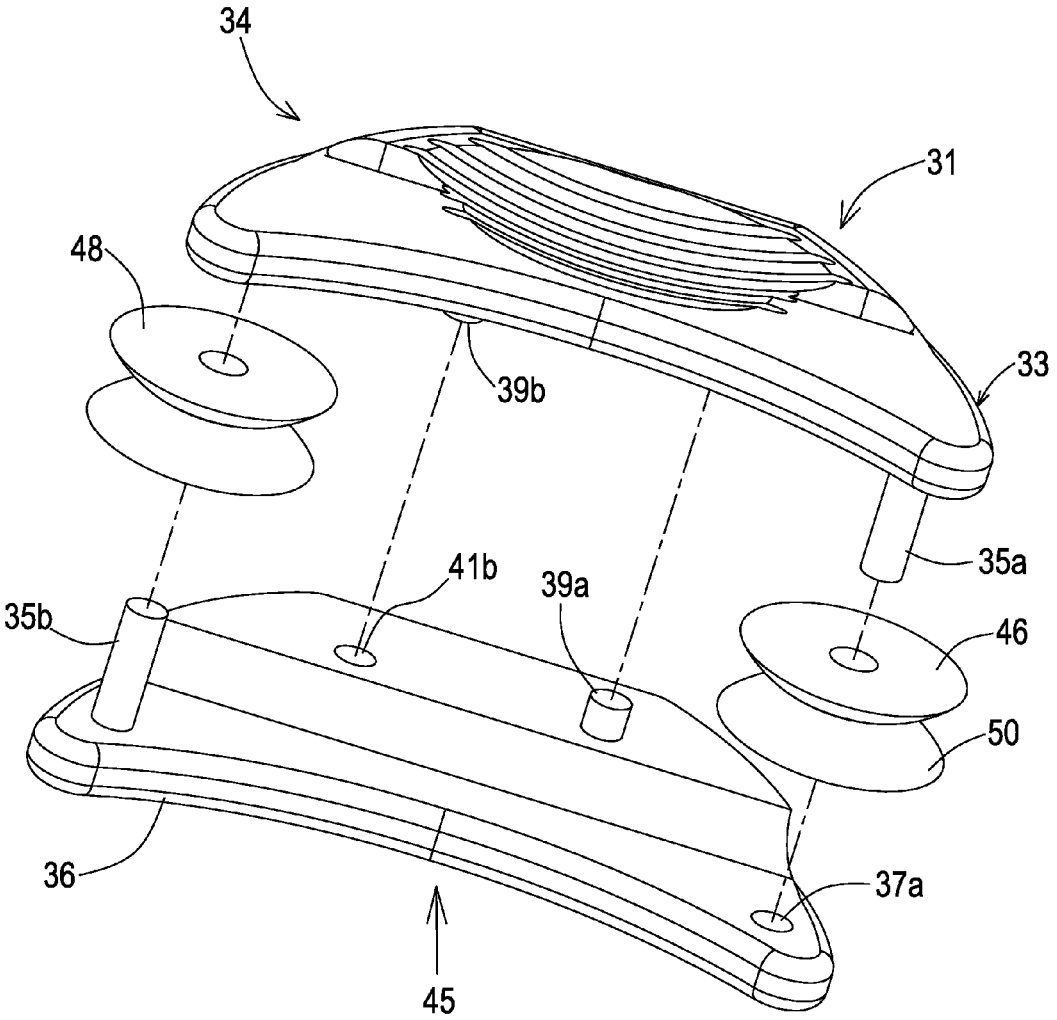
FIG. 6 shows an exploded view of the inventive closure tool of FIG. 2.

FIG. 6 shows a front perspective exploded view of the closure tool 30 of FIG. 2. Closure tool 30 comprises four main parts: side portion 34, side portion 36 and wheels 46, 48. On the inner face of side portion 36 there is formed pin 35*b*, on which wheel 48 is mounted, and on the inner face of side portion 34 is pin 35*a* on which wheel 46 is mounted. Pins 35*b* and 35*a* are inserted into hole 37*b* (not shown) formed in the inner face of side portion 34, and hole 37*a* formed on the inner face of side portion 36, respectively, when the parts are to be assembled for use of the tool. Additional joining connectors 39*a*, 39*b* formed on inner faces of side portions 36, 34 are inserted into holes 41*a* (not shown), 41*b*, respectively, formed on the inner faces of side portions 34, 36, respectively. This construction provides additional structural stability when closure tool 30 is assembled.

Figure 7:
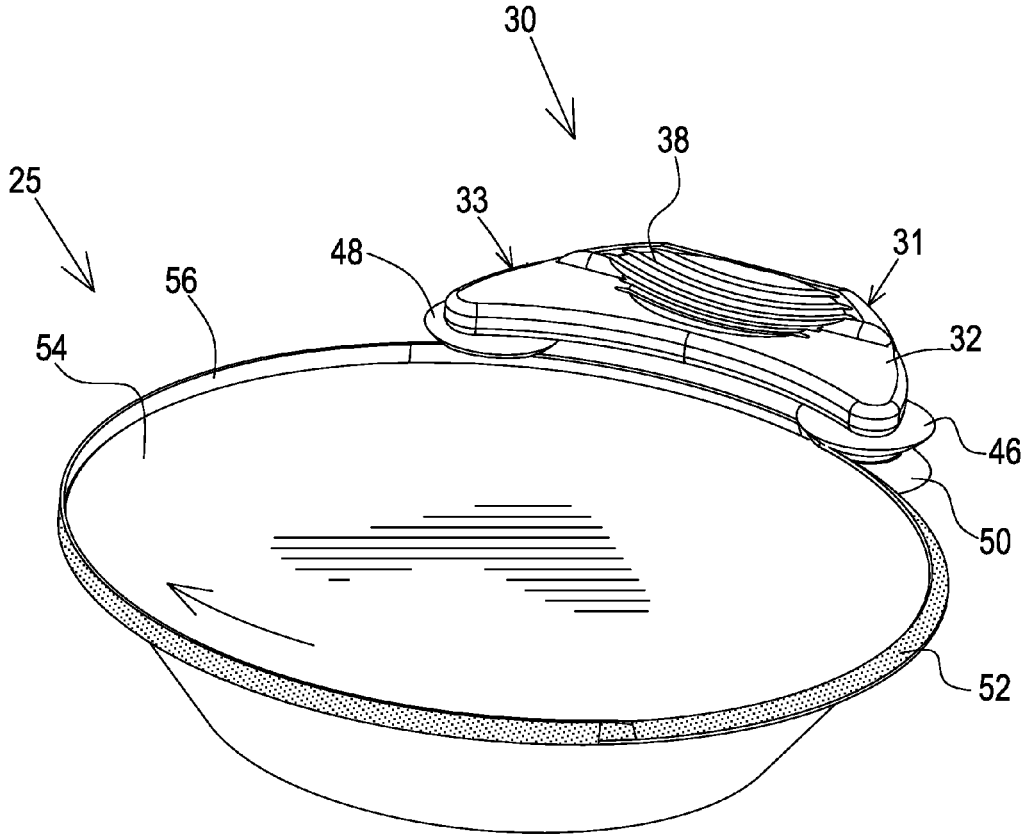
FIG. 7 shows a perspective view of a container to which there is applied a preferred embodiment of the closure tool of FIG. 2.

Referring now to FIG. 7, there is shown a top perspective view of a foil container 25 to which there is applied a preferred embodiment of a closure tool 30 constructed and operated in accordance with the principles of the present invention.

Tapered contour 50 of wheels 46, 48 is shaped to engage a peripheral flange 52 formed on the foil container 25, with the flange being thin enough to bend. Tapered contour 50 of wheels 46, 48 faces outwardly from the bottom 45 of closure tool 30 and is thereby exposed in order to engage flange 52.

In use, when a lid 54 is placed over the top of the foil container 25 so that its outer edge 56 is aligned proximate the peripheral vertical flange 52 of the foil container all along its circumference, the closure tool 30 can be used to close the foil container. This is achieved by applying pressure via the pair of closure tool wheels 46, 48 against the peripheral flange 52 of the foil container, thereby bending it over the outer edge 56 of the lid 54, as the foil container 25 is moved in a circular fashion, thereby closing it. The application angle of tool 30 to flange 52 is controlled by the user by rotating his/her wrist.

Based on the design of the inventive closure tool 30, the pair of wheels 46, 48 provides two points of contact between the closure tool 30 and the foil container 25 peripheral flange 52, both points of contact providing both bending and crimping action simultaneously. This design feature stabilizes the closure tool 30 as foil container 25 is moved in a circular fashion. The stability of the closure tool 30 against the peripheral flange 52 of the foil container 25 enables the foil container 25 closure to be accomplished in a single, continuous motion.

Figure 8:
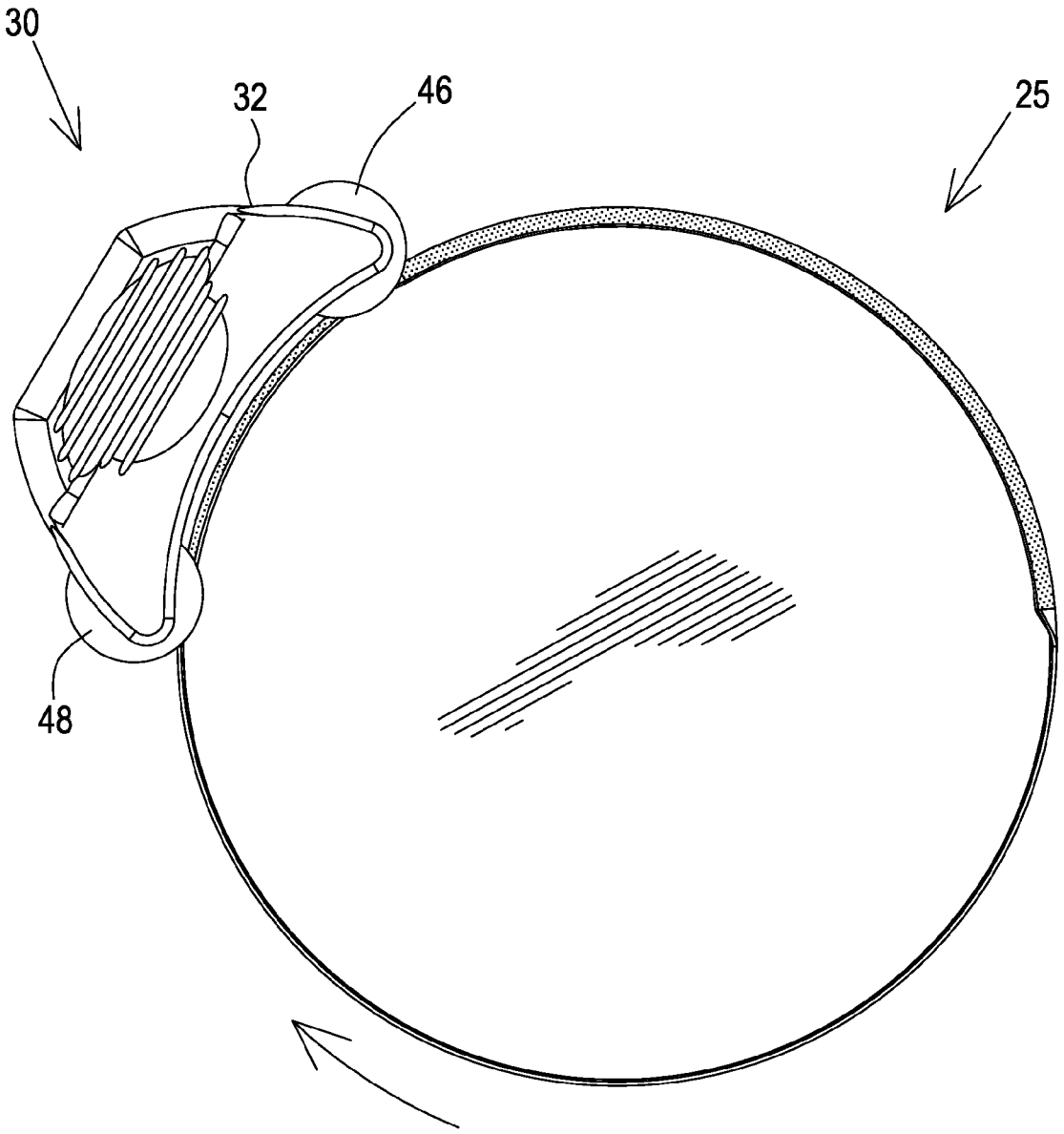
FIG. 8 shows a top view of the container of FIG. 7, showing the closure tool applied to the peripheral flange of the container.

Referring now to FIG. 8 there is shown a top view of the foil container of FIG. 7, showing the closure tool applied to the peripheral flange of the foil container.

The container may be manufactured from one of foil, paper, plastic and any other materials suited for packing food Having described the invention with regard to particular embodiments thereof it is to be understood that the description is not meant as a limitation, since further modifications will now become apparent to those skilled in the art, and it is intended to cover such modifications as fall within the scope of the appended claims.

I claim:

1. A container closure tool comprising:

a portable, unsupported hand-held housing;

at least one pair of wheels each rotatably mounted on a respective end of said housing, each wheel being formed with a tapered contour, said contour being oriented so as to face outwardly of said housing on the bottom of said wheel, such that when a lid is placed over the container with the outer edge of the lid aligned proximate a peripheral vertical flange of the container all along its circumference, and said tapered contour of each of said at least one pair of wheels is simultaneously placed so as to engage the peripheral flange of the container, said at least one pair of wheels providing at least two points of contact on the container peripheral flange, said both points of contact providing both bending and crimping action simultaneously, so that application of closure tool pressure against said flange while moving the container in a circular direction causes simultaneous bending and crimping action on said flange inwardly at said two points of contact so as to retain the container lid all along its circumference in a single, continuous hand motion, and wherein said portable hand-held housing comprises a pair of identical side portions wherein each of said side portions comprises an inner face, and a joining connector extending from one of said inner faces so as to be insertable into a hole formed opposite thereto on said inner face of said opposite side portion.

2. The tool of claim 1 wherein said pair of side portions are constructed of rigid materials.

3. The tool of claim 1 wherein said pair of side portions extend parallel to each other, thereby defining a hollow space therebetween for mounting said pair of wheels.

4. The tool of claim 3 wherein said side portions each comprise two lower ends, wherein said lower ends are arch-shaped thereby defining a pair of oppositely located rounded corners.

5. The tool of claim 4 wherein there is formed on said inner face of one of said pair of oppositely located rounded corners a pin extending therefrom and a hole formed to receive said pin on said opposite rounded corner, wherein each of said pins are inserted into each of said holes from said parallel side portion.

6. The tool of claim 5 wherein said wheel is mounted on said pin within said hollow space.

7. The tool of claim 1 wherein each of said side portions further comprises an upper end, wherein an elongated handle is formed thereon.

8. The tool of claim 7 wherein said handle is formed with ribs for easy gripping.

9. The tool of claim 1 further comprising multiple joining connectors and holes wherein said joining connectors are inserted into said holes when said pair of side portions are assembled together for use of said tool, wherein insertion of said joining connectors into said holes provides structural stability to said closure tool.

10. The tool of claim 9 wherein said side portions can be disassembled and reassembled quickly and easily, enabling easy cleaning and maintenance of the tool.

11. The tool of claim 1 wherein the container may be manufactured from one of foil, paper, plastic and any other materials suited for packing food.

* * * * *